US008143523B2

(12) United States Patent
Dalrymple et al.

(10) Patent No.: US 8,143,523 B2
(45) Date of Patent: Mar. 27, 2012

(54) DOWNHOLE CABLE WITH THERMALLY CONDUCTIVE POLYMER COMPOSITES

(75) Inventors: Larry V. Dalrymple, Claremore, OK (US); David W. Livingston, Claremore, OK (US); Don C. Cox, Roanoke, TX (US)

(73) Assignee: Baker Hughes Incorporated, Houston, TX (US)

( * ) Notice: Subject to any disclaimer, the term of this patent is extended or adjusted under 35 U.S.C. 154(b) by 137 days.

(21) Appl. No.: 12/255,294

(22) Filed: Oct. 21, 2008

(65) Prior Publication Data

US 2010/0096161 A1 Apr. 22, 2010

(51) Int. Cl.
*H01B 7/00* (2006.01)

(52) U.S. Cl. ..... 174/113 R; 174/120 R; 174/120 SC

(58) Field of Classification Search ..... 174/110 R, 174/113 R, 120 R, 121 R
See application file for complete search history.

(56) References Cited

U.S. PATENT DOCUMENTS

| | | | | |
|---|---|---|---|---|
| 2,953,627 | A * | 9/1960 | Malneritch et al. | 174/102 R |
| 3,784,732 | A * | 1/1974 | Whitfill, Jr. | 174/108 |
| 4,375,313 | A * | 3/1983 | Anderson et al. | 385/103 |
| 4,440,974 | A * | 4/1984 | Naudet | 174/108 |
| 4,913,964 | A * | 4/1990 | Fujii et al. | 428/379 |
| 5,082,995 | A * | 1/1992 | Paterson et al. | 174/113 R |
| 6,297,455 | B1 * | 10/2001 | Wijnberg et al. | 174/113 R |
| 6,392,151 | B1 * | 5/2002 | Rafie et al. | 174/106 R |
| 6,451,422 | B1 | 9/2002 | Nguyen | |
| 6,600,108 | B1 * | 7/2003 | Mydur et al. | 174/120 R |
| 6,649,843 | B2 * | 11/2003 | Aoyama et al. | 174/126.1 |
| 6,779,927 | B2 * | 8/2004 | Cens et al. | 385/84 |
| 6,795,060 | B2 * | 9/2004 | Rekimoto et al. | 345/173 |
| 6,797,382 | B2 | 9/2004 | Nguyen et al. | |
| 6,908,669 | B2 | 6/2005 | Nguyen | |
| 7,119,283 | B1 * | 10/2006 | Varkey et al. | 174/102 R |
| 7,235,743 | B2 * | 6/2007 | Varkey | 174/102 R |
| 2007/0044993 | A1 * | 3/2007 | Varkey | 174/102 R |

* cited by examiner

*Primary Examiner* — William Mayo, III
(74) *Attorney, Agent, or Firm* — Bracewell & Giuliani LLP

(57) ABSTRACT

A cable for transmitting electricity for use with an electric submersible pump has a plurality of conductors for conducting electricity along the length of the cable. A first layer of insulation surrounds each of the conductors. A jacket, or second layer of insulation, surrounds all of the conductors and the first layer of insulation. Both the first layer of insulation and the jacket insulation are comprised of an polymeric compound. At least one of the insulation layers has filler material dispersed therein, the filler material having a higher level of thermal conductivity than the insulation layer it is contained in.

12 Claims, 2 Drawing Sheets

DOWNHOLE CABLE WITH THERMALLY CONDUCTIVE POLYMER COMPOSITES

FIELD OF THE INVENTION

This invention relates, in general, to thermally conductive polymer composites. The present invention relates, in particular, to downhole cables with polymer composites.

BACKGROUND OF THE INVENTION

Within an electric submersible pump assembly, a cable extends downhole, terminating in a motor lead to provide power to an electric motor. When electrical power is transmitted through conductors, such as those found in a downhole electric submersible pump cable, heat is generated. Conductors are typically surrounded by insulation. Current electrical insulation polymers have poor thermal conductivity, causing heat to build up. Thermal conductivity values for standard insulation elastomers may range from 0.00238 W/cm K to 0.002428 W/cm K. In some cases, this forces a user to select a larger conductor size, which is costly. In some applications, due to space restraints, increasing conductor size is not practical.

SUMMARY OF THE INVENTION

A power cable for an electric submersible pump assembly is constructed with enhanced thermally conductive insulation. The insulation is formed by mixing a polymer with a filler material to create a thermally conductive composite material. Examples of polymers used may include EPDM rubber, nitrile rubber, HNBR rubber, Aflas rubber, FKM rubber, polypropylene (PP), polyethylene (PE), cross-linked PE or PP, thermoplastic elastomers, fluoropolymers, thermoplastics, and thermoset elastomers. Examples of fill materials used may include ceramic additives such as silicon oxide, aluminum oxide, zirconium oxide, silicon nitride, silicon carbide, aluminum nitride, boron carbide, boron nitride, and yitrium oxide, metal powders, and carbon in various forms. The thermally conductive material can be used as insulation around the conductors and also as jacket material for the cables. The thermally conductive composite polymers dissipate heat across the cable more efficiently and quickly than with a standard insulating material. The composite materials may have thermal conductivity values that range from 20 to 100 times that of standard insulation material.

DETAILED DESCRIPTION OF THE INVENTION

Figure 1:
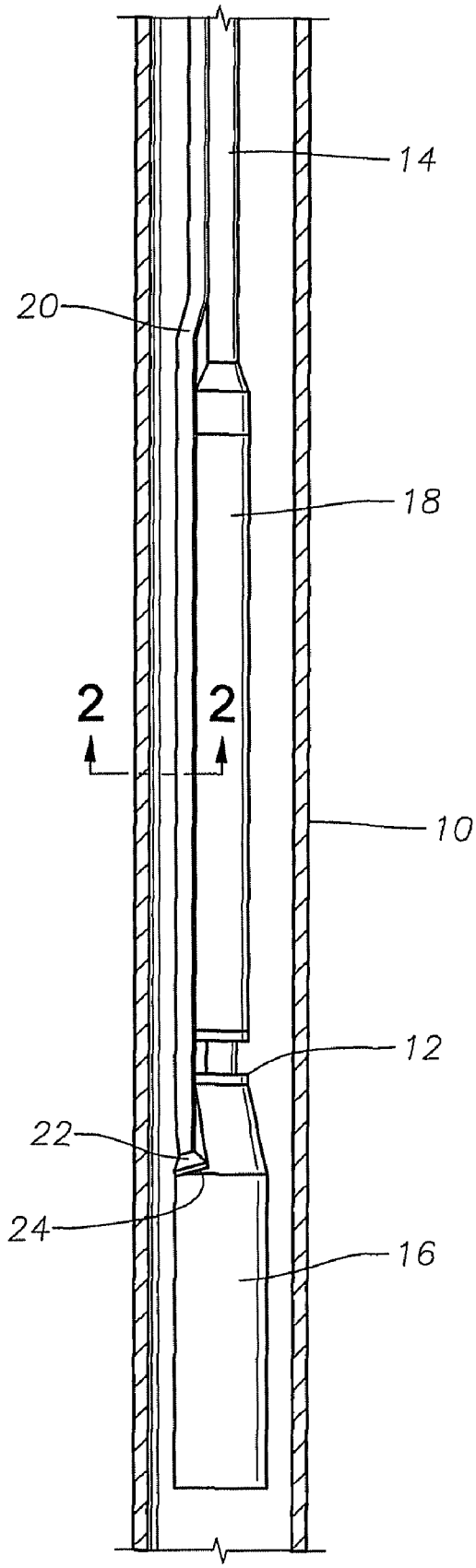
FIG. 1 is an elevational view of a well within which an electric submersible pump is disposed.

FIG. 1 is an elevational section view of a well 10 having an electric submersible pump 12 disposed therein, mounted to a string of tubing 14. Pump 12 includes an electric motor 16 and a pump section comprising a centrifugal pump assembly 18. A cable 20 extends downhole, terminating in a motor lead to provide power to an electric motor 16. A pothead connector 22 is mounted to the motor lead of cable 20, and electrically connects and secures the motor lead of cable 20 to the housing 24 of motor 16.

Figure 2:
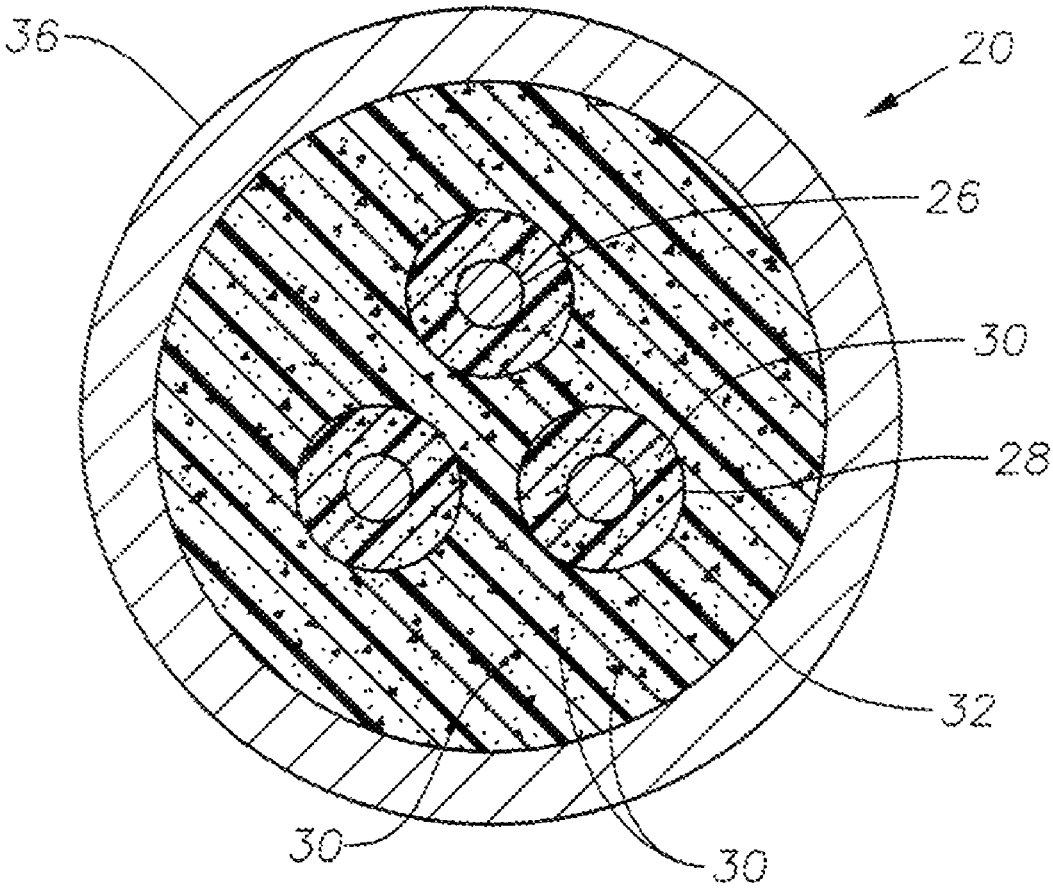
FIG. 2 is a cross sectional view taken along the line 2-2 of FIG. 1.

Referring to FIG. 2, cable 20 comprises three conductors 26 that transmit electricity along the length of cable 20. Cable 20 may contain a different number of conductors depending upon the application. Conductors 26 are constructed of conductive materials such as copper. Electrical insulation 28 surrounds each of the conductors 26. Insulation 28 is typically not electrically conductive. Jacket material 32 surrounds conductors 26 and insulation 28. Jacket material 32 can be either electrically conductive or electrically non-conductive depending upon the application. Conductors 26, insulation 28, and jacket material 32 are typically surrounded by an armored layer or sheathing 36 that protects the cable 20.

Insulation 28 and jacket material 32 can be constructed from various polymer compounds, including: EPDM rubber (Ethylene Propylene diene monomer), nitrile rubber, HNBR rubber, aflas rubber, FKM rubber, polypropylene, polyethylene, cross-linked PE or PP, thermoplastic elastomers, fluoropolymers, thermoplastics or thermoset elastomers. In this embodiment, filler materials 30 are included within the insulation 28 and jacket material 32. Alternately, the filler materials 30 could be located only in jacket material 32. The filler materials 30 may be used to improve thermal conductivity values of the insulation 28 and jacket material 32. In one embodiment, the filler materials 30 are uniformly distributed throughout the insulation 28 and jacket material 32. Examples of filler materials 30 include: ceramic additives such as silicon oxide, aluminum oxide, zirconium oxide, silicon nitride, silicon carbide, aluminum nitride, boron carbide, boron nitride, and yitrium oxide, metal powders, and carbon in various forms. Filler materials 30 are of higher thermal conductivity than the thermoplastic electrical insulation 28 or jacket material 32. The filler materials 30 are not absorbed into the thermo-plastic, rather they remain as discrete particles. Filler materials are typically electrically non-conductive. However, if the application does not require the conductors to be electrically insulated, electrically conductive filler materials could be employed. When reinforced with the various materials, the polymer compounds demonstrate improved thermal conductivity.

The loading for the insulation 28 and jacket material 32 may contain filler material levels ranging from 10 to 80%, and may be used with polymer concentrations of 20 to 90% to obtain a desired thermal conductivity. The enhanced composite polymer compounds may produce thermal conductivity values that range from 20 to 100 times the thermal conductivity values for standard insulation materials.

While the invention has been shown in only one of its forms, it should be apparent to those skilled in the art that it is not so limited but is susceptible to various changes without departing from the scope of the invention. For example, although the cable is shown with a round, circular geometry, it could have a flat, rectangular geometry. Additionally, polymer composites could be employed in other similar applications, such as in a heater cable.

The invention claimed is:

1. An electric cable for a submersible pump assembly comprising:

an electrical cable adapted to be connected to a motor of the submersible pump assembly for supplying electrical power to the motor, the electrical cable having:

three conductors for conducting electricity along a length of the cable to the motor to power the motor;

a separate layer of polymeric electrical insulation surrounding each of the three conductors, defining three separate insulated conductors adjacent to each other the electrical insulation being selected from a list of polymeric materials consisting of EPDM rubber, nitrile rubber, HNBR rubber, Aflas rubber, FKM rubber, polypropylene (PP), polyethylene (PE), and cross-lined PE or PP;

a layer of polymeric protective material surrounding the three insulated conductors;

the layer of polymeric electrical insulation containing a filler material of particles having a higher thermal conductivity than polymeric material within the layer of polymeric electrical insulation for assisting in transferring heat away from the conductors;

the filler material being selected from a group consisting essentially of ceramic additives such as silicon oxide, aluminum oxide, zirconium oxide, silicon nitride, silicon carbide, aluminum nitride, boron carbide, boron nitride and yitrium oxide; and wherein the layer of polymeric electrical insulation is electrically nonconductive.

2. The cable of claim 1, wherein the filler material comprises boron nitride particles.

3. The cable of claim 1, wherein the filler material comprises ceramic particles.

4. An electric submersible pump assembly comprising:

an electric submersible pump;

a motor connected to the electric submersible pump;

an electrical cable connected to the motor for supplying electrical power to the motor, the electrical cable having:

three conductors for conducting electricity along a length of the cable to the motor to power the motor;

a layer of polymeric electrical insulation surrounding the three conductors and being selected from a list of polymeric materials consisting of EPDM rubber, nitrile rubber, HNBR rubber, Aflas rubber, FKM rubber, polypropylene (PP), polyethylene (PE), and cross-lined PE or PP;

a layer of polymeric protective material surrounding the layer of polymeric insulation;

the layer of polymeric electrical insulation containing a filler material having a higher thermal conductivity than the polymeric material in layer of polymeric electrical insulation to enhance thermal conductivity away from the conductors, the filler material being selected from a group consisting essentially of ceramic additives such as silicon oxide, aluminum oxide, zirconium oxide, silicon nitride, silicon carbide, aluminum nitride, boron carbide, boron nitride and yitrium oxide; and wherein the layer of polymeric electrical insulation is electrically nonconductive.

5. The pump assembly of claim 4, wherein the filler material is also contained within the layer of polymeric protective material.

6. The pump assembly of claim 4, wherein the filler material comprises boron nitride particles.

7. The pump assembly of claim 4, wherein the filler material comprises ceramic particles.

8. An electric submersible pump assembly comprising:

an electric submersible pump;

a motor connected to the electric submersible pump;

an electrical cable connected to the motor for supplying electrical power to the motor, the electrical cable having:

three conductors for conducting electricity along a length of the cable to the motor to power the motor;

a separate layer of polymeric electrical insulation surrounding each of the three conductors, defining three separate insulated conductors adjacent to each other, the layer of polymeric electrical insulation being selected from a list of polymeric materials consisting of EPDM rubber, nitrile rubber, HNBR rubber, Aflas rubber, FKM rubber, polypropylene (PP) polyethylene (PE), and cross-lined PE or PP ;

a layer of polymeric protective material surrounding the three insulated conductors;

the layer of polymeric electrical insulation containing a filler material of particles having a higher thermal conductivity than polymeric material contained in the layer of polymeric electrical insulation for assisting in heat transfer away from the conductor, the filler material being selected from a group consisting essentially of ceramic additives such as silicon oxide, aluminum oxide, zirconium oxide, silicon nitride, silicon carbide, aluminum nitride, boron carbide, boron nitride and yitrium oxide; and wherein the layer of polymeric electrical insulation is electrically nonconductive.

9. The pump assembly of claim 8, wherein the filler material comprises boron nitride particles.

10. The pump assembly of claim 8, wherein the filler material comprises ceramic particles.

11. The pump assembly of claim 8, wherein the quantity by weight of the filler material to the material of the electrical insulation is between 20 to 90% polymeric material and between 10 to 80% filler material.

12. The pump assembly of claim 8, wherein the material of the electrical insulation layer comprises EPDM.

* * * * *